US005757120A

United States Patent [19]

Honda et al.

[11] Patent Number: 5,757,120

[45] Date of Patent: May 26, 1998

[54] COLOR CATHODE RAY TUBE WITH DECENTERABLE MAGNETIC BODY

[75] Inventors: Masanobu Honda; Isao Yonetani, both of Osaka, Japan

[73] Assignee: Matsushita Electronics Corporation, Osaka, Japan

[21] Appl. No.: 733,402

[22] Filed: Oct. 18, 1996

[30] Foreign Application Priority Data

Nov. 8, 1995 [JP] Japan ..... 7-290215

[51] Int. Cl.[6] ..... H01J 29/74

[52] U.S. Cl. ..... 313/437; 313/440

[58] Field of Search ..... 313/433, 431, 313/428, 437, 440

[56] References Cited

U.S. PATENT DOCUMENTS 4,782,264 11/1988 Yamazaki et al. ..... 313/433
4,933,596 6/1990 Yoshii et al. ..... 313/440
4,943,753 7/1990 Hevesi .
5,475,282 12/1995 Liao .
5,486,736 1/1996 Lee et al. .

FOREIGN PATENT DOCUMENTS 60-264024 12/1985 Japan .

*Primary Examiner*—George W. Dombroske
*Assistant Examiner*—Max H. Noori
*Attorney, Agent, or Firm*—Merchant, Gould, Smith, Edell, Welter & Schmidt, P.A.

[57] ABSTRACT

A color cathode ray tube device is provided in which the generation of the trapezoidal distortion of a rectangular raster is controlled and an off-axis misconvergence is corrected to obtain high image quality in the peripheral portion of a screen. An annular ferrite core is provided adjacently to the electron gun side end face of a ferrite core of a deflection yoke so as to b decentered radially within the predetermined range around the central axis of the deflection yoke in the tube axial direction. An asymmetric magnetic field is formed on the electron gun side of the deflection yoke by the annular ferrite core which has been decentered. Thus, the off-axis misconvergence can be corrected while controlling the generation of the trapezoidal distortion.

6 Claims, 8 Drawing Sheets

COLOR CATHODE RAY TUBE WITH DECENTERABLE MAGNETIC BODY

FIELD OF THE INVENTION

The present invention relates to a color cathode ray tube device, and more particularly to a color cathode ray tube device having high image quality for a display monitor.

BACKGROUND OF THE INVENTION

With the spread of the Windows (Trademark of Microsoft Co., Ltd.) an operating system for a personal computer, a display monitor has often displayed information at the peripheral portion of a screen of a color cathode ray tube. For this reason, it is required that the color cathode ray tube device should display fine images at the peripheral portion of the screen as well as the central portion thereof. Convergence performance is one of the important factors to determine the quality of images at the peripheral portion of the screen. The requirements have been very strict.

The basic requirements for enhancing the convergence performance are to reduce an off-axis misconvergence caused by the shift of the central axis of a deflection yoke and that of an electron gun.

As a method for correcting the off-axis misconvergence, an asymmetric magnetic field is formed on the screen side of the deflection yoke by tilting the deflection yoke as disclosed in Japanese Unexamined Patent Publication No. 60-264024.

According to the method for tilting the deflection yoke, however, the asymmetric magnetic field is formed on the screen side of the deflection yoke so that a raster distortion that is referred to as a trapezoidal distortion is caused easily. Consequently, image quality is deteriorated at the peripheral portion of the screen due to the trapezoidal distortion.

SUMMARY OF THE INVENTION

In order to solve such a problem according to the prior art, it is an object of the present invention to provide a color cathode ray tube device in which an asymmetric magnetic field is not formed on the screen side of the deflection yoke but on the electron gun side to correct an off-axis misconvergence so that the generation of a trapezoidal distortion is controlled and convergence performance is enhanced.

In order to accomplish the above-mentioned object, the present invention provides a color cathode ray tube device comprising a color cathode ray tube body having a glass panel portion and a glass funnel portion connected to the rear part of the glass panel portion, an electron gun housed in the rear part of the glass funnel portion, a deflection yoke which is provided on the outer periphery of the rear part of the glass funnel portion and has a saddle type horizontal coil, an insulating frame provided on the outside of the saddle type horizontal coil, a vertical coil and a ferrite core provided on the outside of the insulating frame, and a magnetic body forming a closed magnetic circuit which can be decentered is provided between the position where the horizontal deflection magnetic field strength on the central axis of the deflection yoke in the tube axial direction is at its maximum and the main lens of the electron gun.

According to the structure of the color cathode ray tube device, the asymmetric deflection magnetic field is formed on the electron gun side by the magnetic body forming the closed magnetic circuit which is provided between the position where the horizontal deflecting magnetic field strength on the central axis of the deflection yoke in the tube axial direction is the maximum and the main lens of the electron gun. Consequently, the off-axis misconvergence is corrected.

It is preferable that the magnetic body forming the closed magnetic circuit (for example, an annular ferrite core) should be arranged adjacent to the electron gun side end face of the ferrite core forming the deflection yoke.

Furthermore, it is preferable that the vertical coil should be a saddle type vertical coil, and the ferrite core should be provided on the outside of the saddle type vertical coil.

As described above, the color cathode ray tube device according to the present invention provides the magnetic body forming the closed magnetic circuit which is provided between the position where the horizontal deflection magnetic field strength on the central axis of the deflection yoke in the tube axial direction is the maximum and the main lens of the electron gun. The off-axis misconvergence can be corrected by the asymmetric magnetic field formed by decentering the magnetic body. Consequently, the generation of the trapezoidal distortion is controlled so that the convergence quality can be enhanced and the image quality can be improved in the peripheral portion of a screen.

DETAILED DESCRIPTION OF THE INVENTION

The concept and preferred embodiment of the present invention will be described below with reference to the drawings.

Figure 4A:
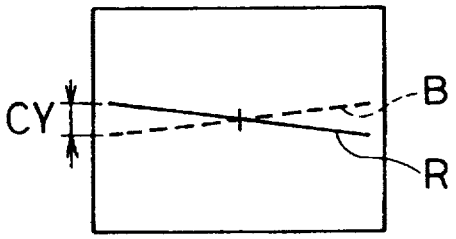
FIGS. 4A and 4B are diagrams showing another off-axis misconvergence in the horizontal direction.
Figure 4B:
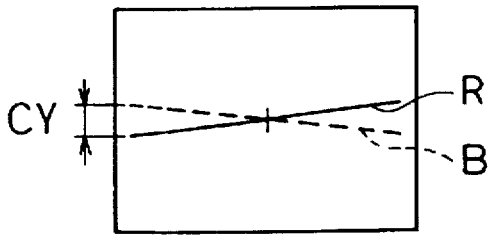
Figure 5A:
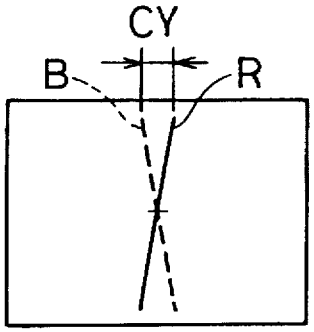
FIGS. 5A and 5B are diagrams showing an off-axis misconvergence in the vertical direction.
Figure 5B:
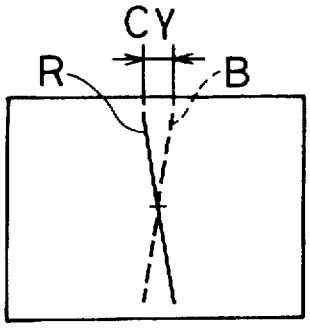
Figure 6A:
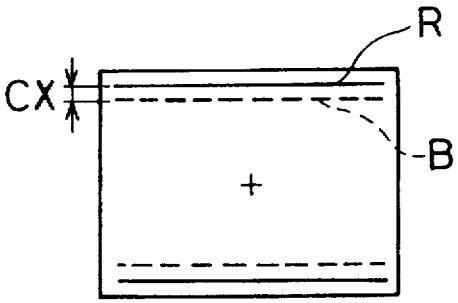
FIGS. 6A and 6B are diagrams showing another off-axis misconvergence in the vertical direction.
Figure 6B:
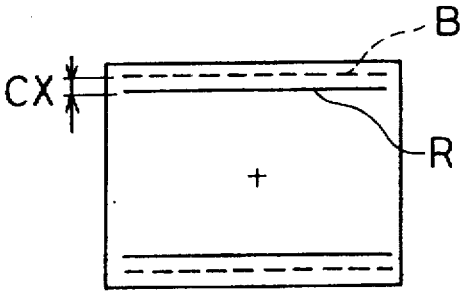

As shown in FIGS. 3A to 6B, four kinds of off-axis misconvergences are generated when the central axis of a deflection yoke in the tube axial direction having a self-converging magnetic field is not coincident with that of three electron guns which are inline-arranged in the direction of a horizontal axis. These misconvergences will be hereinafter referred to as XHS (FIGS. 3A and 3B), XVS (FIGS. 4A and 4B), YHS (FIGS. 5A and 5B), and YVS (FIGS. 6A and 6B). XHS and YVS are generated when the central axis of the electron gun in the tube axial direction is shifted in the horizontal direction with respect to the central axis of the deflection yoke in the tube axial direction. XVS and YHS are generated when the central axis of the electron gun in the tube axial direction is shifted in the vertical direction with respect to the central axis of the deflection yoke in the tube axial direction.

XHS and YVS can be corrected by tilting the deflection yoke in the horizontal direction. XVS and YHS can be corrected by tilting the deflection yoke in the vertical direction.

Figure 7A:
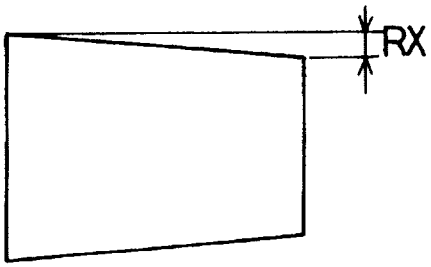
FIGS. 7A and 7B are diagrams showing the trapezoidal distortion generated on the upper and lower sides of a rectangular raster when the deflection yoke is tilted in the horizontal direction.
Figure 7B:
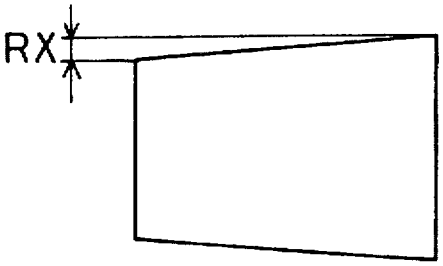
Figure 8A:
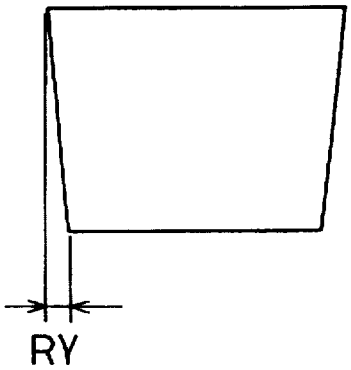
FIGS. 8A and 8B are diagrams showing the trapezoidal distortion generated on the right and left sides of the rectangular raster when the deflection yoke is tilted in the vertical direction.
Figure 8B:
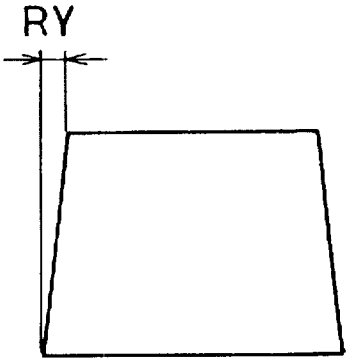

However, a method for correcting the off-axis misconvergence by tilting the deflection yoke is effective in enhancing convergence performance. On the other hand, asymmetric components are generated on a deflection magnetic field on the screen side of the deflection yoke by the tilting operation. For this reason, a raster distortion, which is referred to as a trapezoidal distortion, is generated easily. More specifically, the horizontal tilting operation generates the trapezoidal distortion on the upper and lower sides of a rectangular raster as shown in FIGS. 7A and 7B. The vertical tilting operation generates the trapezoidal distortion on the right and left sides of the rectangular raster as shown in FIGS. 8A and 8B.

The trapezoidal distortion is easily generated by the asymmetric deflection magnetic field on the screen side of the deflection yoke for the following reason. The load function, which indicates the degree of influence of the asymmetric deflection magnetic field with respect to the trapezoidal distortion, raises the tube axial coordinates (Z-axis coordinates) to the 3.5 to 3.7th power. As the asymmetric deflection magnetic field is closer to the screen side, the influence of the asymmetric deflection magnetic field becomes greater.

In the color cathode ray tube device according to the present invention, the asymmetric deflection magnetic field is formed on the electron gun side of the deflection yoke to correct the off-axis misconvergence while controlling the generation of the trapezoidal distortion so that the convergence performance can be enhanced.

Figure 1:
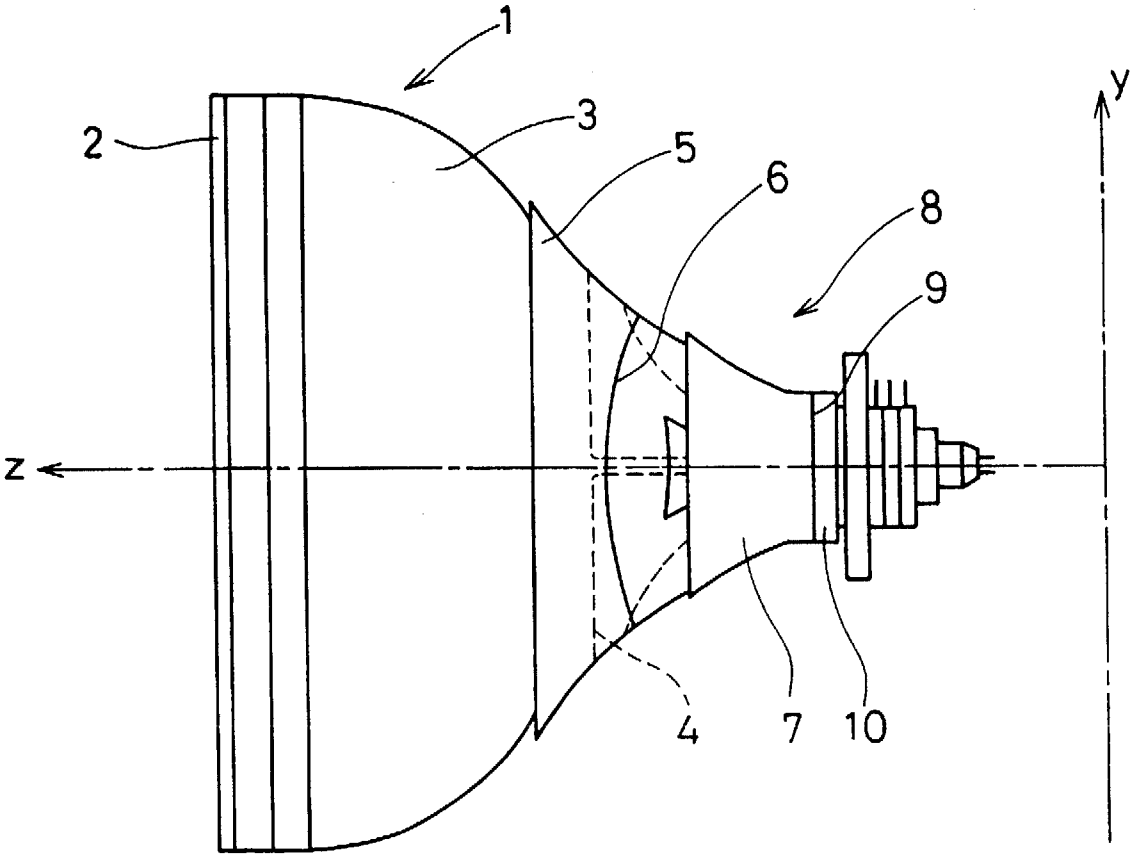
FIG. 1 is a side view showing a color cathode ray tube device according to an embodiment of the present invention.

FIG. 1 is a side view showing a color cathode ray tube device of 41 cm (17") and 90° according to the present embodiment of the present invention. A color cathode ray tube body 1 comprises a glass panel portion 2 and a glass funnel portion 3 connected to the rear part of the glass panel portion 2. An electron gun (not shown) is housed in the rear part (neck portion) of the glass funnel portion 3. A deflection yoke 8 is attached to the outer periphery of the rear part of the glass funnel portion 3. The deflection yoke 8 has a saddle type horizontal coil 4, an insulating frame 5 provided on the outside of the saddle type horizontal coil 4, a saddle type vertical coil 6 provided on the outside of the insulating frame 5, and a ferrite core 7 provided on the outside of the saddle type vertical coil 6.

An annular ferrite core 10 having an outer diameter of 70 mm, an inner diameter of 53 mm and a thickness of 5 mm is attached adjacent to an electron gun side end face 9 of the ferrite core 7. The annular ferrite core 10 can be radially decentered within a predetermined range around the central axis of the deflection yoke 8 in the tube axial direction. The coordinates (Z-axis coordinates) of the annular ferrite core 10 in the tube axial direction are set apart by 15 mm to the electron gun side with respect to a position where the horizontal deflection magnetic field strength on the central axis of the deflection yoke in the tube axial direction is at its maximum.

Figure 2:
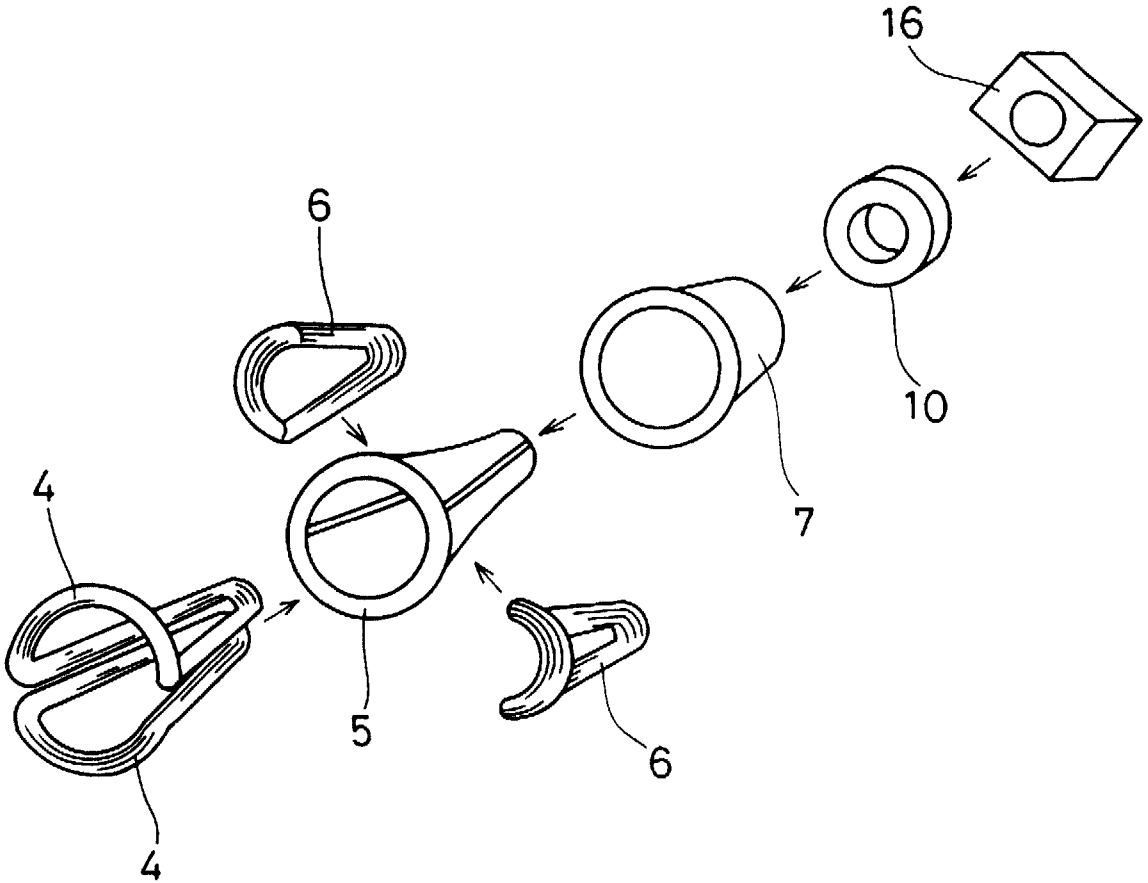
FIG. 2 is an exploded view showing a deflection yoke and a ring-shaped ferrite core forming the color cathode ray tube device shown in FIG. 1.

FIG. 2 is an exploded view of the deflection yoke 8 and the annular ferrite core 10. The saddle type horizontal coil 4 is attached to the inside of the insulating frame 5, and the saddle type vertical coil 6 is attached to the outside thereof. The ferrite core 7 is attached to the outside of the saddle type vertical coil 6. Then, the annular ferrite core 10 is attached on the rear end opening side and a cover 16 is fixed.

Figure 3A:
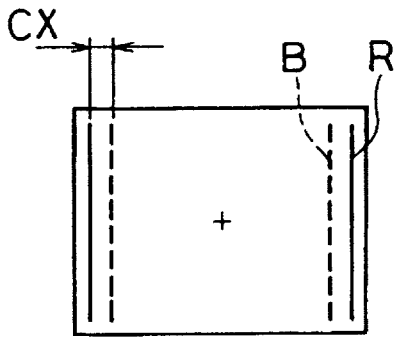
FIGS. 3A and 3B are diagrams showing an off-axis misconvergence in the horizontal direction.

In the color cathode ray tube device having the above-mentioned structure according to the present invention, if the central axis of the electron gun in the tube axial direction is shifted to the right seen from the screen side with respect to the central axis of the deflection yoke in the tube axial direction, the off-axis misconvergence XHS shown in FIG. 3A and the off-axis misconvergence YVS shown in FIG. 6A are generated. However, these off-axis misconvergences can be corrected by decentering the annular ferrite core 10 to the right.

Figure 9:
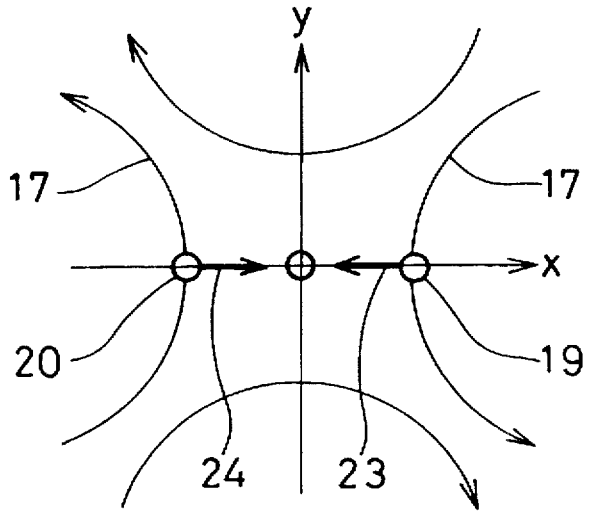
FIG. 9 is a diagram for explaining the principle in which an asymmetric magnetic field that is formed by decentering the annular ferrite core to the right acts on electron beams that are deflected to the right so that the off-axis misconvergence is corrected.
Figure 10:
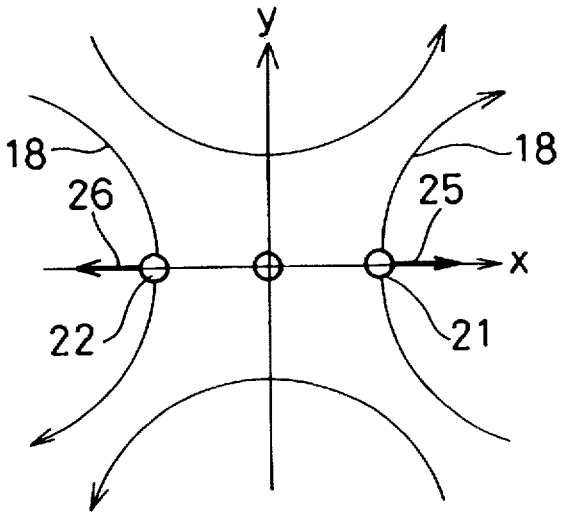
FIG. 10 is a diagram for explaining the principle in which the asymmetric magnetic field that is formed by decentering the annular ferrite core to the right acts on the electron beams that are deflected to the left so that the off-axis misconvergence is corrected.
Figure 11:
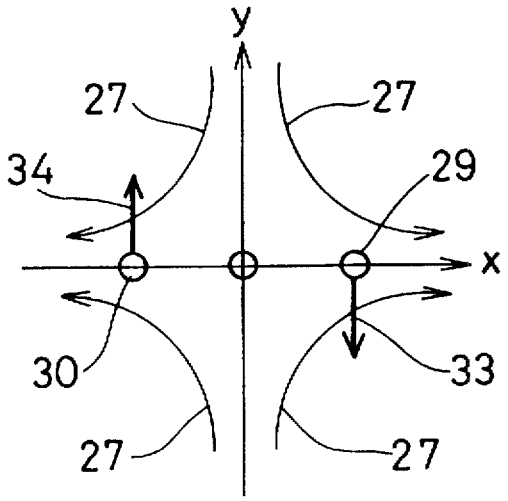
FIG. 11 is a diagram for explaining the principle in which the asymmetric magnetic field that is formed by decentering the annular ferrite core to the right acts on the electron beams that are deflected upward so that the off-axis misconvergence is corrected.
Figure 12:
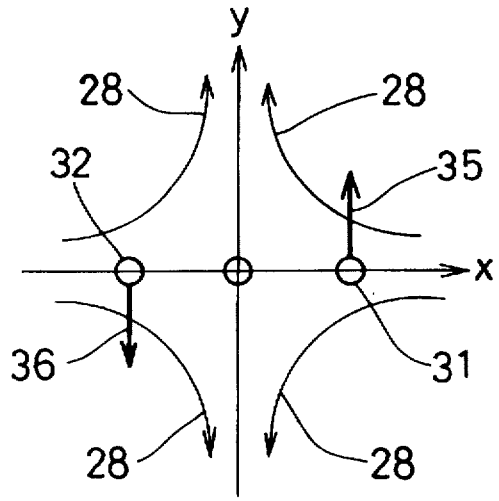
FIG. 12 is a diagram for explaining the principle in which the asymmetric magnetic field that is formed by decentering the annular ferrite core to the right acts on the electron beams that are deflected downward so that the off-axis misconvergence is corrected.

More specifically, in the case where electron beams are deflected to the right or left, an asymmetric magnetic field 17 or 18 is formed as shown in FIG. 9 or 10. A Lorentz's force 23 or 25 acts on a red emission electron beam 19 or 21, and a Lorentz's force 24 or 26 acts on a blue emission electron beam 20 or 22. Consequently, the off-axis misconvergence XHS shown in FIG. 3A is corrected. In the case where the electron beam is deflected upward or downward, an asymmetric magnetic field 27 or 28 is formed as shown in FIG. 11 or 12 so that a Lorentz' force 33 or 35 acts on a red emission electron beam 29 or 31 and a Lorentz's force 34 or 36 acts on a blue emission electron beam 30 or 32. Thus, the off-axis misconvergence YVS shown in FIG. 6A is corrected.

Figure 3B:
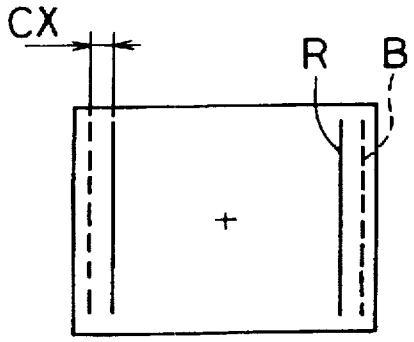

By the same principle, the off-axis misconvergences XHS and YVS shown in FIGS. 3B and 6B, which are generated when the central axis of the electron gun in the tube axial direction is shifted to the left seen from the screen side with respect to the central axis of the deflection yoke in the tube axial direction can be corrected by decentering the annular ferrite core 10 to the left.

In the case where the central axis of the electron gun in the tube axial direction is decentered upward seen from the screen side with respect to the central axis of the deflection yoke in the tube axial direction, the off-axis misconvergences XVS and YHS shown in FIGS. 4A and 5A are generated. The off-axis misconvergences XVS and YHS can be corrected by decentering the annular ferrite core 10 upward. Similarly, the off-axis misconvergences XVS and YHS shown in FIGS. 4B and 5B, which are generated when the central axis of the electron gun in the tube axial direction is decentered downward seen from the screen side with respect to the central axis of the deflection yoke in the tube axial direction, can be corrected by decentering the annular ferrite core 10 downward.

Figure 13:
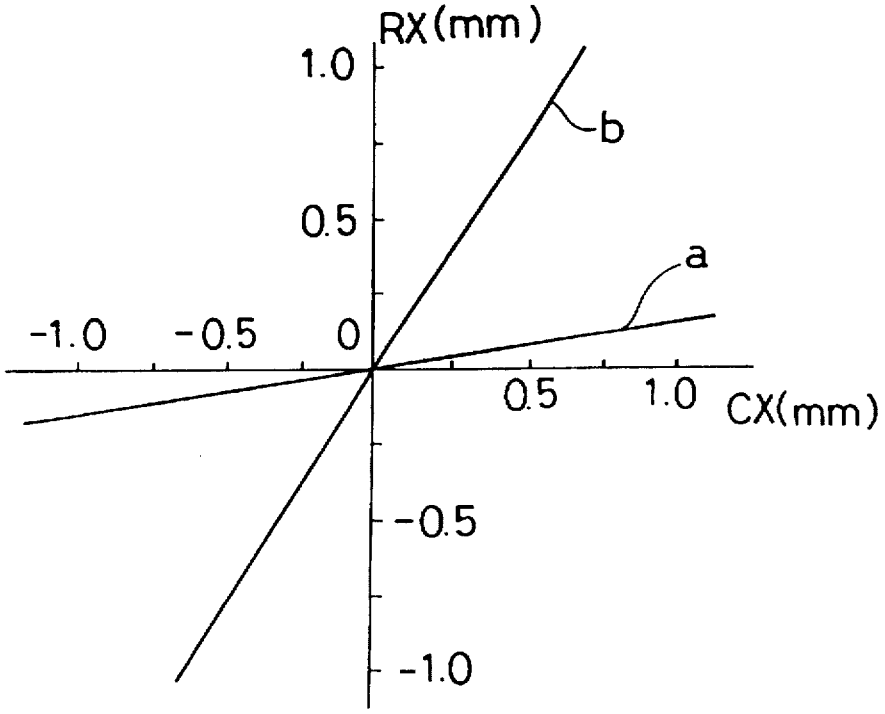
FIG. 13 is a graph showing the relationship between the amount of an off-axis misconvergence correction CX and a trapezoidal distortion RX in the cases where the annular ferrite core is decentered in the horizontal direction and where the deflection yoke is tilted in the horizontal direction.

In a graph of FIG. 13, a straight line a shows the relationship between the amount of a correction CX (see FIGS. 3A and 3B and FIGS. 6A and 6B) and a trapezoidal distortion RX (see FIGS. 7A and 7B) obtained when decentering the annular ferrite core 10 in the horizontal direction to correct the off-axis misconvergences XHS and YVS. For comparison, a straight line b shows the relationship between the amount of a correction CX and the trapezoidal distortion RX obtained when tilting the deflection yoke 8 in the horizontal direction to correct the off-axis misconvergences XHS and YVS.

Figure 14:
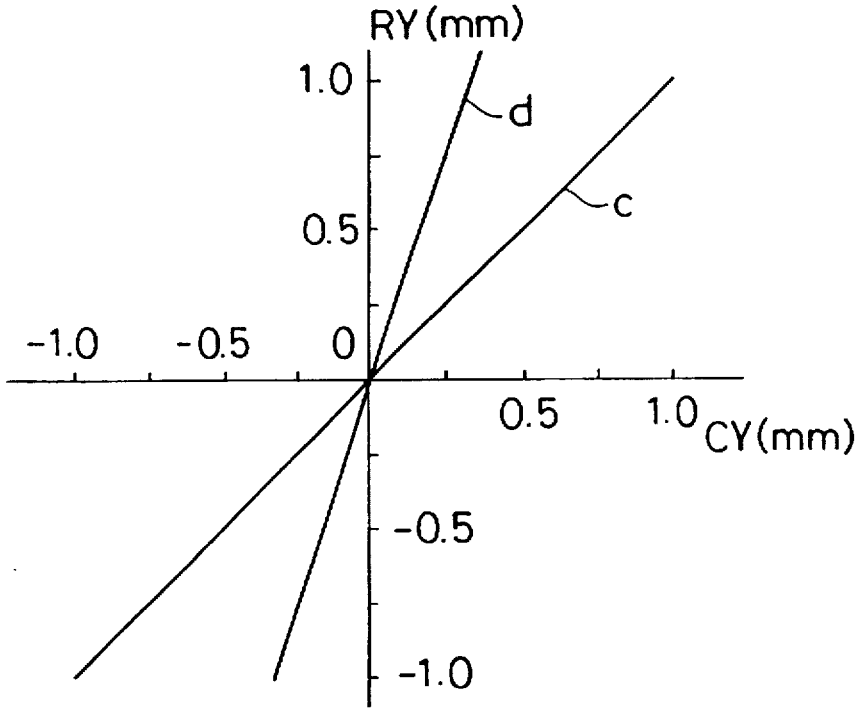
FIG. 14 is a graph showing the relationship between the amount of an off-axis misconvergence correction CY and a trapezoidal distortion RY in the cases where the annular ferrite core is decentered in the vertical direction and where the deflection yoke is tilted in the vertical direction.

In a graph of FIG. 14, a straight line c shows the relationship between the amount of a correction CY (see FIGS. 4A and 4B and FIGS. 5A and 5B) and a trapezoidal distortion RY (see FIGS. 8A and 8B) obtained when decentering the annular ferrite core 10 in the vertical direction to correct the off-axis misconvergences XVS and YHS. For comparison, a straight line d shows the relationship between the amount of a correction CY and the trapezoidal distortion RY obtained by tilting the deflection yoke 8 in the vertical direction to correct the off-axis misconvergences XVS and YHS.

As is apparent from FIGS. 13 and 14, the trapezoidal distortion generated by decentering the annular ferrite core to correct the off-axis misconvergence is 33% or less of the trapezoidal distortion generated by tilting the deflection yoke to correct the off-axis misconvergence. Accordingly, it was found that useful effects can be produced by forming the asymmetric magnetic field on the electron gun side to correct the off-axis misconvergence.

In the above-mentioned embodiment, the annular ferrite core for correcting the off-axis misconvergence is arranged adjacent to the electron gun side end face of the ferrite core of the deflection yoke. The annular ferrite core in the tube axial direction may be positioned in any place between the main lens of the electron gun and the position where the horizontal deflection magnetic field strength on the central axis of the deflection yoke in the tube axial direction is at its maximum. In the case where the annular ferrite core is arranged on the rear side of the main lens of the electron gun, the amount of the deflection magnetic field blown off to the electron gun side is very small. Consequently, it is hard to form the asymmetric magnetic field. Thus, the effects cannot be obtained for correcting the off-axis misconvergence. On the contrary, if the annular ferrite core is arranged on the front side (screen side) of the position where the horizontal deflection magnetic field strength on the central axis of the deflection yoke in the tube axial direction is at its maximum, the amount of the trapezoidal distortion which is generated is increased so that the expected object cannot be accomplished.

While the annular ferrite core has been used as a magnetic body forming a closed magnetic circuit, the shape is not restricted to a ring but may be an ellipse, a square or a rectangle. If the closed magnetic circuit is formed, any shape can be used. The material is not restricted to the ferrite core but may be a magnetic body having a magnetic permeability which is greater than that of the air.

While the saddle type vertical deflection coil has been used in the above-mentioned embodiment, the present invention can be applied to the case where a toroidal type vertical deflection coil is used. In this case, the ferrite core is not located on the outside of the vertical deflection coil but the vertical deflection coil is wound onto the ferrite core.

The invention may be embodied in other forms without departing from the spirit or essential characteristics thereof. The embodiments disclosed in this application are to be considered in all respects as illustrative and not restrictive, the scope of the invention is indicated by the appended claims rather than by the foregoing description, and all changes which come within the meaning and range of equivalency of the claims are intended to be embraced therein.

What is claimed is:

1. A color cathode ray tube device comprising:

a color cathode ray tube body having a glass panel portion and a glass funnel portion connected to the rear part of the glass panel portion;

an electron gun having a main lens, housed in a rear part of the glass funnel portion;

a deflection yoke which is provided on the outer periphery of the rear part of the glass funnel portion and has a saddle type horizontal coil, an insulating frame provided on the outside of the saddle type horizontal coil, a vertical coil and a ferrite core provided on the outside of the insulating frame; and a magnetic body forming a closed magnetic circuit, which is able to be decentered with respect to the tube axis, is provided between the position where the horizontal deflection magnetic field strength on the central axis of the deflection yoke in the tube axial direction is at its maximum and the main lens of the electron gun.

2. The color cathode ray tube device as defined in claim 1, wherein the magnetic body forming the closed magnetic circuit is an annular ferrite core.

3. The color cathode ray tube device as defined in claim 1, wherein the magnetic body forming the closed magnetic circuit is arranged adjacent to the electron gun side end face of the ferrite core forming the deflection yoke.

4. The color cathode ray tube device as defined in claim 2, wherein the magnetic body forming the closed magnetic circuit is arranged adjacent to the electron gun side end face of the ferrite core forming the deflection yoke.

5. The color cathode ray tube device as defined in claim 1, wherein the magnetic body forming the closed magnetic circuit is able to be decentered so that a misconvergence is corrected.

6. The color cathode ray tube device as defined in claim 1, wherein the vertical coil is a saddle type vertical coil, and the ferrite core is provided on the outside of the saddle type vertical coil.

* * * * *